US010663994B2

(12) United States Patent
Lin

(10) Patent No.: US 10,663,994 B2
(45) Date of Patent: May 26, 2020

(54) AUTO-CALIBRATED BANDGAP REFERENCE

(71) Applicant: MACRONIX INTERNATIONAL CO., LTD., Hsinchu (TW)

(72) Inventor: Hsiao-Ming Lin, Taoyuan (TW)

(73) Assignee: MACRONIX INTERNATIONAL CO., LTD., Hsinchu (TW)

( * ) Notice: Subject to any disclaimer, the term of this patent is extended or adjusted under 35 U.S.C. 154(b) by 0 days.

(21) Appl. No.: 15/915,441

(22) Filed: Mar. 8, 2018

(65) Prior Publication Data

US 2019/0278312 A1 Sep. 12, 2019

(51) Int. Cl.

| | |
|---|---|
| ***G05F 1/46*** | (2006.01) |
| ***G05F 1/563*** | (2006.01) |
| ***G05F 1/575*** | (2006.01) |
| ***G05F 3/30*** | (2006.01) |

(52) U.S. Cl.

CPC ..... *G05F 1/468* (2013.01); *G05F 1/575* (2013.01)

(58) Field of Classification Search

CPC . G05F 1/465; G05F 1/563; G05F 3/30; G05F 1/575

See application file for complete search history.

(56) References Cited

U.S. PATENT DOCUMENTS 6,462,612 B1 10/2002 Roh et al.
7,112,948 B2 * 9/2006 Daly ..... G05F 3/30 323/316
7,342,390 B2 * 3/2008 Tachibana ..... G05F 3/30 323/313
7,560,979 B1 * 7/2009 Hsu ..... G05F 3/30 327/539
7,948,304 B2 * 5/2011 Aruga ..... G05F 3/30 327/513
8,022,752 B2 * 9/2011 Pelgrom ..... H02M 3/07 327/536
8,248,158 B2 * 8/2012 Osawa ..... H03F 3/45475 327/124

(Continued)

OTHER PUBLICATIONS

Ge, et al., "A Single-Trim Bandgap Reference With a 3? Inaccuracy of ± 0.15% From ? 40 ? C to 125 ? C," IEEE Journal of Solid-State Circuits, vol. 46, No. 11, pp. 2693-2701, Nov. 2011.

(Continued)

*Primary Examiner* — Adolf D Berhane
*Assistant Examiner* — Sisay G Tiku
(74) *Attorney, Agent, or Firm* — Haynes Beffel & Wolfeld, LLP

(57) ABSTRACT

A voltage reference generator which can be automatically calibrated has a first mode and a second mode. The voltage reference generator provides a bandgap reference voltage with a voltage reference node having a capacitance. Calibration logic, which can be on the same integrated circuit device as the voltage reference generator, executes a calibration sequence including enabling the voltage reference generator in the first mode to produce a voltage on the voltage reference node, holding the voltage by the capacitance, and then enabling the voltage reference generator in the second mode and calibrating the voltage reference generator in the second mode relative to the voltage held on the voltage reference node, to provide the bandgap reference voltage.

20 Claims, 9 Drawing Sheets

(56) References Cited

U.S. PATENT DOCUMENTS

| | | | | |
|---|---|---|---|---|
| 8,704,588 | B2 * | 4/2014 | Conte | G05F 3/30 323/313 |
| 8,736,387 | B2 * | 5/2014 | Mahooti | G05F 3/30 331/143 |
| 8,786,358 | B2 * | 7/2014 | Endo | G05F 3/245 327/513 |
| 8,947,067 | B1 * | 2/2015 | Zarei | G05F 3/30 323/313 |
| 9,285,822 | B2 * | 3/2016 | Fukazawa | G05F 3/30 |
| 10,268,226 | B1 * | 4/2019 | Wang | G05F 3/222 |
| 2007/0052473 | A1 * | 3/2007 | McLeod | G05F 3/30 327/539 |
| 2009/0002048 | A1 * | 1/2009 | Fujisawa | G05F 3/30 327/306 |
| 2009/0146751 | A1 * | 6/2009 | Pernia | H03L 1/02 331/117 R |
| 2009/0243571 | A1 * | 10/2009 | Cook | G05F 1/575 323/280 |
| 2010/0295529 | A1 * | 11/2010 | Consoer | G05F 3/30 323/313 |
| 2011/0074520 | A1 * | 3/2011 | Tyan | H04L 25/029 333/32 |
| 2011/0102049 | A1 * | 5/2011 | Conte | G05F 3/30 327/307 |
| 2013/0147271 | A1 * | 6/2013 | Yotsuji | H02J 4/00 307/28 |

OTHER PUBLICATIONS

Van Veldhoven, "A bandgap reference using chopping for reduction of 1/f noise and random offset." (1999).

* cited by examiner

AUTO-CALIBRATED BANDGAP REFERENCE

BACKGROUND

Field

The present invention relates to reference voltage generators based on bandgap reference circuits.

Description of Related Art

Reference voltages are used in a wide variety of circuits. In many circuits, accurate reference voltages can be required that are stable over a wide range of temperature and process variations. Bandgap reference circuits are often used in these circumstances which generate a reference voltage that is a function of the difference between voltages across bandgap junctions on two similar devices, such as the base emitter voltage on two bipolar junction transistors having different sizes.

However, bandgap reference circuits on different devices can generate slightly different reference voltages. One important factor in causing these variations arises from the input offset voltage of operational amplifiers utilized in the circuit. One technique for offsetting this source of error is known as a chopper-stabilized bandgap reference circuit. In a chopper-stabilized bandgap reference circuit, a feedback loop modulates the bandgap voltage on the input side of an operational amplifier, and de-modulates the output of the operational amplifier using a high-speed clock. This can be effective in overcoming errors induced by the input offset voltage, but suffers the penalty of higher operating current and noise on the integrated circuit because of the high-speed clock.

Other methods involve use of calibration or trimming techniques during wafer sort or final test in the manufacturing of an integrated circuit. This method is relatively costly, requiring storing trimming parameters using embedded nonvolatile memory or fuses, and increasing testing times with devices.

A variety of these techniques are described in Ge et al., "A Single-Trim CMOS Bandgap Reference with a 3σ Inaccuracy of +/−0.15% from −40° C. to 125° C.," IEEE Journal Of Solid-State Circuits, Vol. 46, No. 11, November 2011, pages 2693-2701.

It is desirable to provide a bandgap reference circuit which operates with high accuracy, while eliminating one or more of the requirements of high-speed clocks, on-device nonvolatile memory or fuses, and calibration sequences required during manufacturing.

SUMMARY

A voltage reference generator for providing a bandgap reference voltage is described that can operate with relatively low power consumption, reduced noise and without costly calibration sequences executed during manufacturing. In embodiments described herein, the voltage reference generator can be automatically calibrated in-system, in response to power on events for example.

A voltage reference generator which can be automatically calibrated is described, which has a first mode and a second mode. The voltage reference generator provides a bandgap reference voltage to a node having a capacitance. Calibration logic, which can be on the same integrated circuit device as the voltage reference generator, executes a calibration sequence including enabling the voltage reference generator in the first mode to produce a voltage on the node, holding the voltage by the capacitance, and then enabling the voltage reference generator in the second mode and calibrating the voltage reference generator in the second mode relative to the voltage held on the node, to provide the bandgap reference voltage.

The voltage reference generator can include a bandgap reference generator including feedback, such as a chopper-stabilized bandgap reference circuit. The calibration sequence enables the bandgap reference generator in the first mode by enabling a clock signal to modulate the feedback, and enables the bandgap reference generator in the second mode by disabling the clock signal.

Embodiments are described in which the voltage reference generator includes a controllable voltage divider, which can be controlled using an adjustable register or other logic signal source, which can be adjusted during the calibration sequence. For example, the voltage reference generator can include a register-controlled resistor, or register-controlled voltage divider, and the calibration sequence includes adjusting the register. The register can be a volatile register, such as based on flip-flop cells, which lose data during a power-off event. In this example, the calibration logic can be executed after a power-on event for the circuit.

In an example described, the voltage reference generator comprises a bandgap reference circuit generating a first stage bandgap reference voltage on a first stage output node, where the voltage reference generator can be a chopper-stabilized bandgap reference circuit in some embodiments. The bandgap reference circuit in embodiments described has modulated feedback in a first mode and un-modulated feedback in a second mode. The voltage reference generator in the example includes an adjustable voltage regulator connected to the first stage output node which generates a second stage bandgap reference voltage on a second stage output node. The second stage bandgap reference voltage has an offset from the first stage bandgap reference voltage, as a result of different characteristics of the circuit in the first and second modes. A switch is configured to connect a first stage output node to a capacitor on a voltage reference node in the first mode, and to connect the second stage output node to the voltage reference node in the second mode during and after calibration. The adjustable voltage regulator can include the adjustable register-controlled resistor. The calibration sequence includes adjusting the register-controlled resistor from an initial value to a calibrated value, where the calibrated value is maintained during operation of the circuit.

A method is also described that includes enabling a voltage reference generator in a first mode to produce a bandgap reference voltage, sampling the bandgap reference voltage to hold a sampled voltage, enabling the voltage reference generator in a second mode to produce an initial second mode bandgap reference voltage, calibrating the reference voltage generator in the second mode relative to the sampled voltage to produce a calibrated bandgap reference voltage, and applying the calibrated bandgap reference voltage to a voltage reference node on the circuit. Various embodiments of the method can be understood as described further herein.

Other aspects and advantages of the present invention can be seen on review of the drawings, the detailed description and the claims, which follow.

DETAILED DESCRIPTION

A detailed description of embodiments of the present invention is provided with reference to the FIGS. 1-10.

Figure 1:
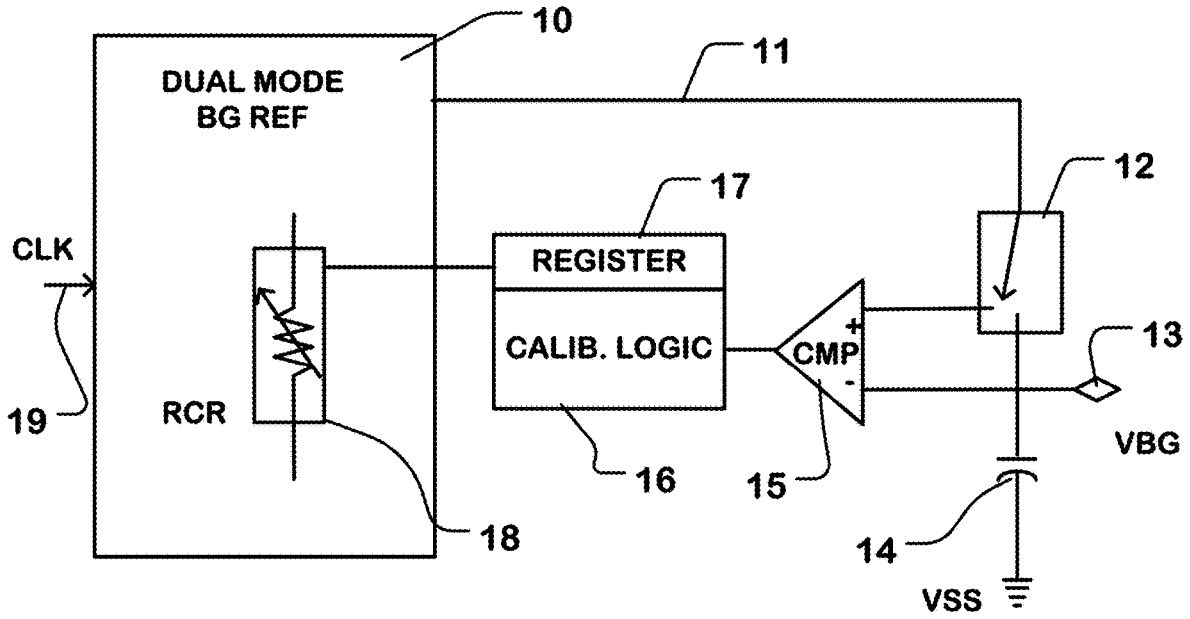
FIG. 1 is a simplified block diagram of a voltage reference generator as described herein.

FIG. 1 illustrates a reference voltage generator which generates a bandgap reference voltage VBG on reference voltage node 13. The reference voltage generator includes a dual-mode bandgap reference circuit 10 which generates a bandgap reference voltage on node 11. The dual-mode bandgap reference circuit 10 can comprise for example a chopper-stabilized bandgap reference having a clock input on line 19. In the first mode, the clock is enabled causing modulation of the feedback in the bandgap reference circuit. In the second mode, the clock is disabled, causing un-modulated feedback in the bandgap reference circuit.

The voltage reference circuit includes calibration logic that comprises a switch 12, in this illustration, which alternately connects node 11 to a first input of the comparator 15, or to the voltage reference node 13. The output of the comparator 15 is connected to calibration logic 16, which stores the results of calibration in a register 17, which can comprise flip-flops or other volatile storage elements. Of course, alternative embodiments may utilize non-volatile storage elements to maintain calibration through power-off events. The register 17 is coupled to a register-controlled resistor 18 in the dual-mode bandgap reference circuit 10, which is trimmed during calibration.

During a first part of the calibration procedure, the switch is configured to connect node 11 to node 13, a voltage on node 11 is produced using the first mode of the dual-mode bandgap reference circuit 10, and the voltage produced is sampled and held by capacitance on node 13, such as provided by a capacitor 14. During a second part of the calibration procedure, the switch is configured to connect node 11 to a first input of the comparator 15, while the second input of the comparator 15 is connected to node 13. The output of the comparator 15 indicates a difference between the second mode bandgap reference voltage on node 11, and the held voltage on the capacitance of node 13. Calibration logic adjusts the value stored in the register 17 which controls the register-controlled resistor 18 in this example. This trims the resistance of the register-controlled resistor in the dual-mode bandgap reference circuit 10 so that the voltage on node 11 has an offset to compensate for the difference in output provided by the first and second modes of the dual-mode bandgap reference circuit 10.

Figure 2:
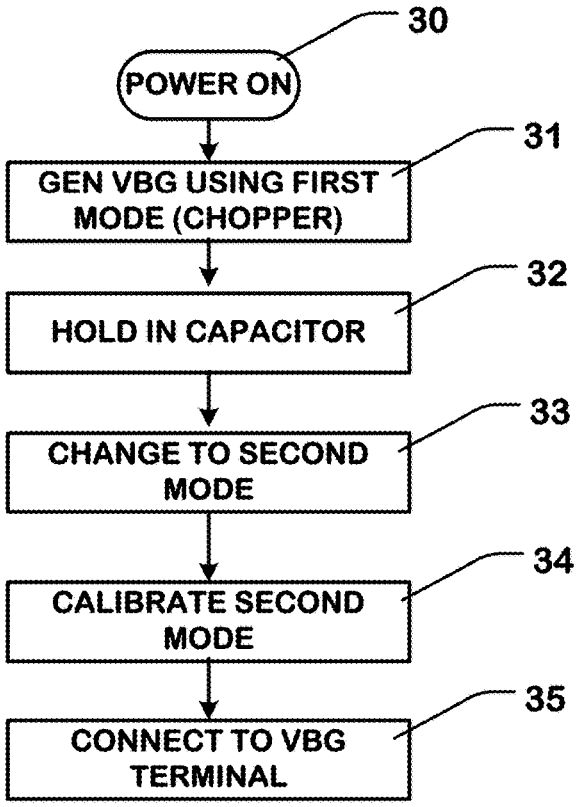
FIG. 2 is a simplified flowchart of a method for producing a bandgap reference voltage, such as can be performed using the configuration of FIG. 1.

FIG. 2 is a simplified flowchart for generating a calibrated bandgap reference voltage. The procedure begins at a power-on event 30, such as detected on an integrated circuit when power is applied or after a reset. According to the process, a bandgap reference voltage is generated using a first mode of a dual mode bandgap reference circuit (31). The voltage generated is sampled and held in a capacitor (32). The bandgap reference circuit is changed to a second mode where a second mode bandgap reference voltage is generated (33). The circuit is calibrated by adjusting the register of the register-controlled resistor in this example, using the second mode of the bandgap reference voltage circuit (34). Upon completion of calibration, the second mode output of the bandgap reference circuit on node 11 is provided a calibrated bandgap reference voltage VBG (35).

Figure 3:
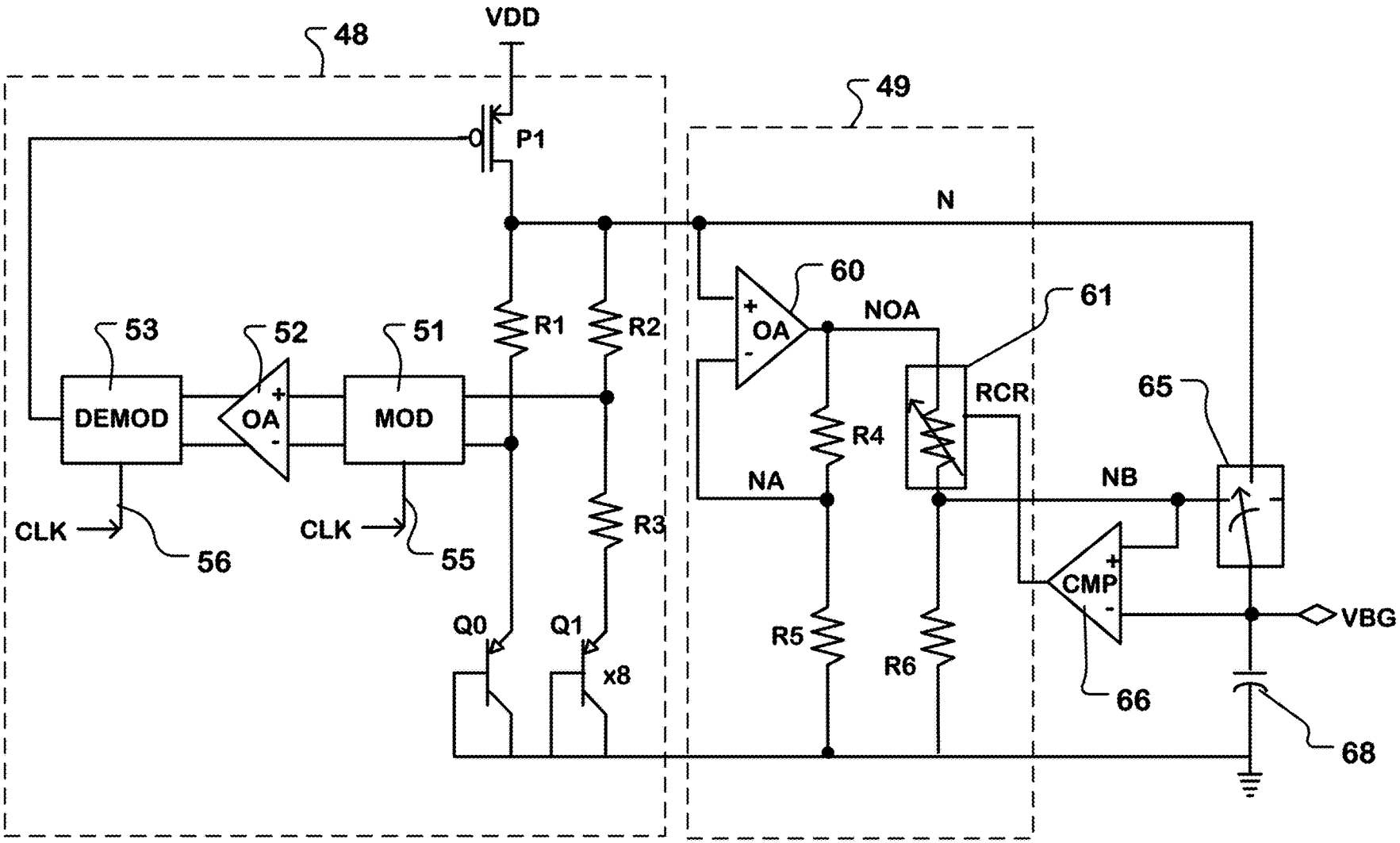
FIG. 3 is a more detailed circuit diagram of a first embodiment of a voltage reference generator as described herein.

FIG. 3 is a more detailed diagram of one embodiment of a voltage reference generator which can be automatically calibrated. In the illustrated embodiment, a chopper-stabilized bandgap reference circuit 48 having a first stage output node N, and a voltage regulator 49 connected to the output node N, and having a regulated, second stage output node NB.

The chopper-stabilized bandgap reference circuit 48 includes a bandgap junction reference that comprises in this example a first PNP bipolar junction transistor Q0 and a second PNP bipolar junction transistor Q1, though other bandgap junction devices such as diodes can be used. The base and collector of the transistors Q0 and Q1 are coupled to a reference node connected to a DC ground. In other embodiments the reference node can be connected to AC ground or other DC voltage reference. The emitter of transistor Q0 is connected through resistor R1 to node N, at the drain of PMOS transistor P1, which has its source connected to the supply potential VDD. The emitter of transistor Q1 is connected through resistors R2 and R3, to node N. The chopper-stabilized bandgap reference circuit includes feedback by which the node at the emitter of Q0 and the node between resistors R2 and R3 are connected to a modulator 51, the outputs of which are connected to inputs of operational amplifier 52. The output of the operational amplifier 52 is a differential modulated signal that is applied to a demodulator 53. The output of the demodulator 53 is connected to the gate of the PMOS transistor P1. This controls the current through the transistors Q0 and Q1.

In a first mode, clock signals on lines 55 and 56 (or a common clock signal on both lines 55 and 56 in some embodiments) which drive the modulator 51 and the demodulator 53, respectively, are enabled. As a result, a chopper-stabilized, first stage bandgap reference voltage is generated on node N using modulated feedback which can automatically compensate for input offset voltage in the operational amplifier 52 in this first mode. In a second mode, the clock signals on lines 55 and 56 are disabled. As a result, the feedback in the chopper compensated bandgap reference circuit passes through the modulator and demodulator without chopping, and is therefore un-modulated. This causes generation in the second mode of a bandgap reference voltage on node N which does not compensate for input offset as well as is done in the first mode.

The voltage regulator 49 includes an operational amplifier 60 having inputs connected to node N and to node NA, and an output at node NOA connected through a first leg comprising resistors R4 and R5 to the reference node, and through a second parallel leg comprising a register-controlled resistor 61 in series with resistor R6 between the output of the operational amplifier 60 and the reference node. A feedback connection is provided at node NA between resistors R4 and R5. The node between the register-controlled resistor 61 and resistor R6 is the second stage output node NB providing a second stage bandgap reference voltage. In effect, the register-controlled resistor 61 and the resistor R6 form a controllable voltage divider, with the node NB at the output. In embodiments of a register-controlled voltage divider, both the top and bottom resistors (61 and R6 in this example) can be register-controlled.

The node N is connected to a switch 65, having a first position in which the output node N is connected to the voltage reference node VBG, a second position in which the regulated output node NB is connected to the voltage reference node VBG, while the output node N is disconnected, and a third position in which both the output node N and the regulated output node NB are disconnected. A comparator 66 has a first input connected to the regulated output node NB, and a second input connected to the voltage reference node VBG. The output of the comparator 66 is coupled to calibration logic which controls a register-controlled resistor 61 in the voltage regulator 49.

The voltage reference generator shown in FIG. 3 can be automatically calibrated using the first mode and second mode of the chopper-stabilized bandgap reference circuit 48. The calibration sequence includes operating the chopper-stabilized bandgap reference circuit 48 in the first mode, including modulated feedback. This generates a first stage bandgap reference voltage on node N. The switch 65 is set to connect node N to the output node VBG, where the voltage is sampled and held on the capacitor 68. While holding the first stage bandgap reference voltage in the capacitor 68, the switch 65 is set to disconnect node N from the output node VBG, and a calibration sequence is executed to adjust the register-controlled resistor 61 until the output of the comparator 66 indicates that the voltage on node NB equals the voltage on node VBG. When the calibration is complete, the switch 65 is set to connect the node NB to the output node VBG. The voltage reference generator is operated in the second mode to maintain a stable bandgap reference voltage at node VBG, calibrated to compensate for variations caused by the differences in the first and second modes of operation of the dual mode bandgap reference circuit.

Figure 4:
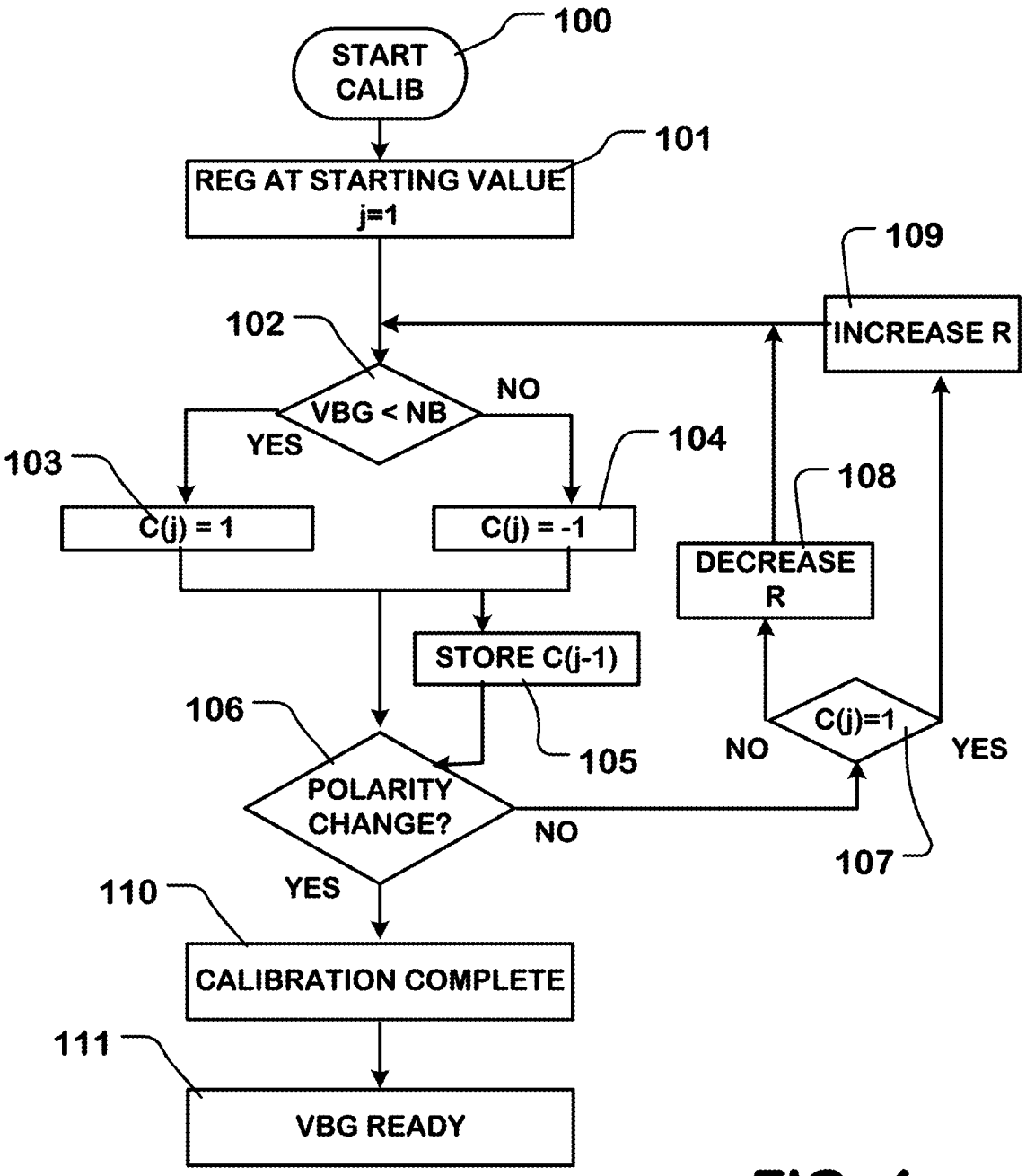
FIG. 4 is a flowchart of a calibration sequence which can be applied for a circuit like that of FIG. 3.

A calibration sequence is illustrated in the flowchart of FIG. 4. This sequence begins with a start calibration signal (100) which is executed a certain amount of time after the first mode bandgap reference voltage has been stably sampled and held. In the sequence, the register of the register-controlled resistor is set at a starting value during a power-on event, and a cycle index j is set to 1 (101). The output of the comparator indicates whether the voltage at node VBG is less than the voltage at node NB (102). If VBG is less than NB, then the comparator output C(j) for cycle j is set to 1 (103). If the voltage VBG is greater than NB, then the comparator output C(j) for cycle j C(j) is set to −1 (104).

The value of C(j) is stored in a shift register so that the value in the previous cycle C(j−1) is available for comparison (105). Next, in the calibration sequence, the logic determines whether there has been a polarity change in the value of C(j) relative to of C(j−1) (106). If not, the sequence determines whether C(j) is equal to 1, indicating that VBG is less than NB. If at block 107, C(j) is not equal to 1, indicating NB is less than VBG, then the register is decremented to decrease the resistance of the register-controlled resistor (108). If C(j) is equal to 1, indicating NB is greater than VBG at block 107, then the register is incremented to increase the resistance of the register-controlled resistor (109). The sequence then returns to block 102 and cycles until a polarity change is detected at block 106. When a polarity change is detected, the calibration is complete and the register value is set (110). Then, the node NB can be connected to the output node VBG, and an automatically calibrated bandgap reference voltage is ready (111). In embodiments utilizing any type of register-controlled voltage divider, the changes in the register move a tap point, which has the effect of changing the resistance of resistors above and below the tap point in some embodiments.

Figure 5:
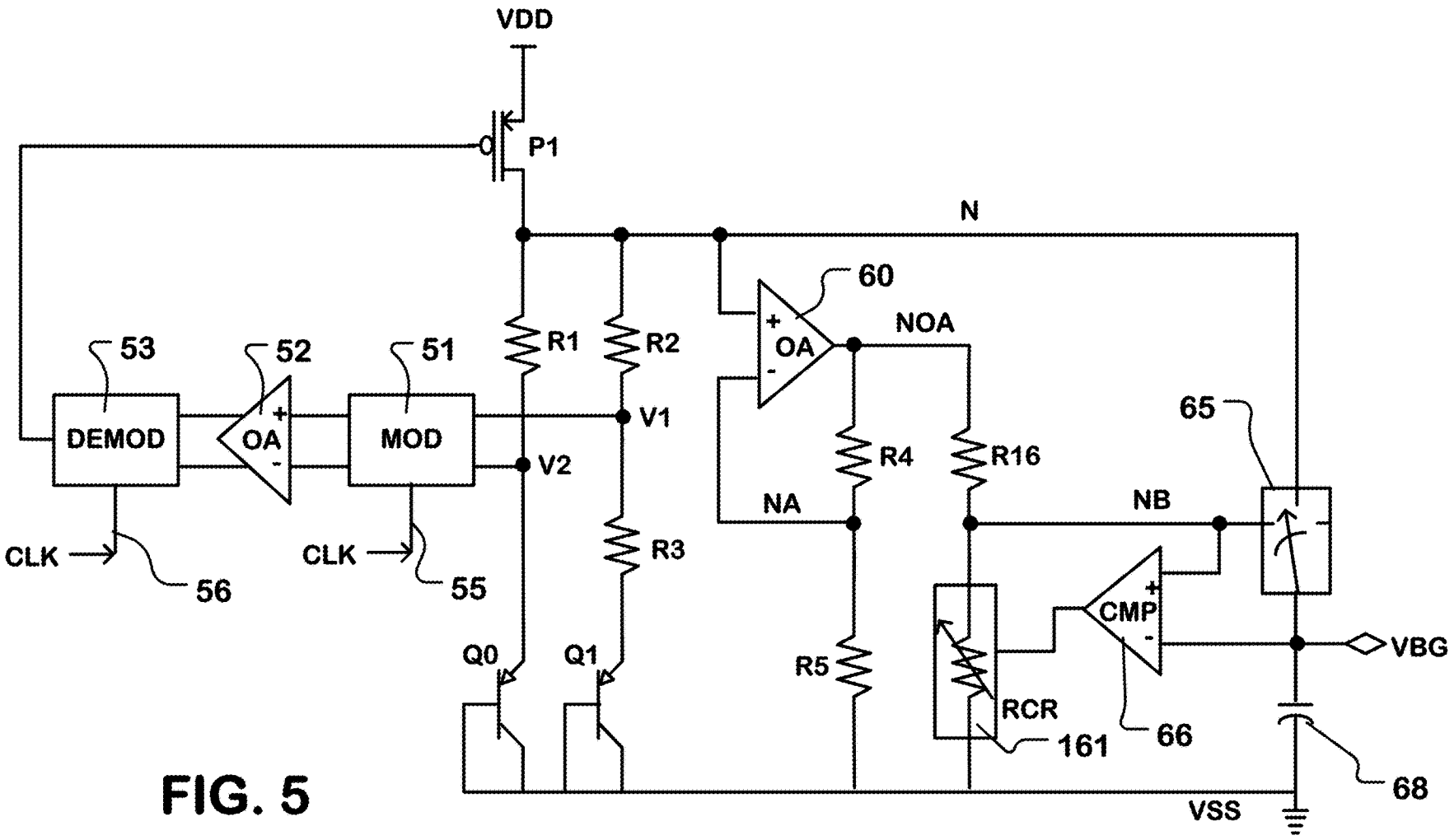
FIG. 5 is a circuit diagram of a second embodiment of a voltage reference generator as described herein.

A number of modifications can be made in the voltage reference generator shown in FIG. 3. For example, one alternative among many possible alternatives, is shown in FIG. 5. The configuration of the circuit in FIG. 5 is like that of FIG. 3, and like reference numerals are used for common components. The difference in the circuits is in the order of the resistors in the second leg on the output of the operational amplifier 60. In FIG. 5, a static resistor R16 is between the output of the operational amplifier 60 and the node NB, and the register-controlled resistor 161 is between the node NB and the reference node. To operate the circuit of FIG. 5, the direction of adjustments of the register-controlled resistor described with reference to FIG. 4 is reversed.

Figure 6:
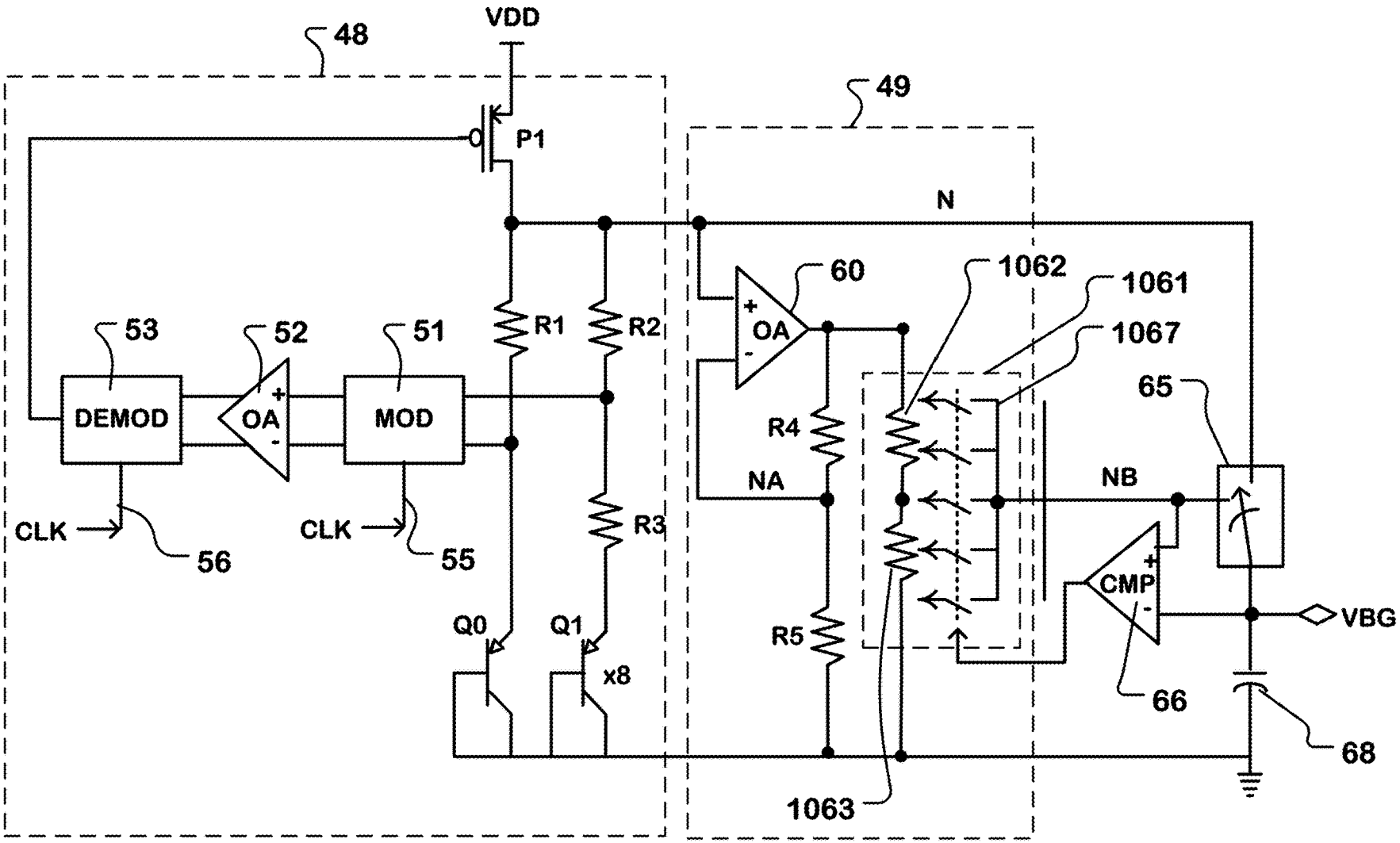
FIG. 6 is a circuit diagram of a third embodiment of a voltage reference generator as described herein.

FIG. 6 illustrates an embodiment using a controllable voltage divider. In the embodiment of FIG. 6, using any type of controllable voltage divider both the top and bottom resistors (61 and R6 in FIG. 3, and 161 and R16 in FIG. 5) can be register-controlled in order to maintain a constant resistance between the output NOA of the operational amplifier 60 and the reference node. The configuration of the circuit in FIG. 6 is like that of FIG. 3, and like reference numerals are used for common components. In the embodiment of FIG. 6, the resistors 61 and R6 in FIG. 3 (equivalent to resistors 161 and R16 in FIG. 5) are replaced by a register controlled voltage divider 1061 between nodes NOA and the reference node. The register controlled voltage divider 1061 has a selectable tap point connected to node NB, by which the resistances above and below the tap point are adjusted. The register controlled voltage divider 1061 comprises a set of series connected resistors (schematically represented by resistor 1062 above node NB and resistor 1063 below node NB) with nodes between the resistors being selectable as tap points for connection to node NB by set of switches 1067. The set of switches 1067 is controlled by calibration logic as discussed above in connection with FIG. 4. In this manner, the resistance above NB, and the resistance below NB can be established during calibration to maintain a stable bandgap reference voltage at node VBG, calibrated to compensate for variations caused by the differences in the first and second modes of operation of the dual mode bandgap reference circuit.

Figure 7:
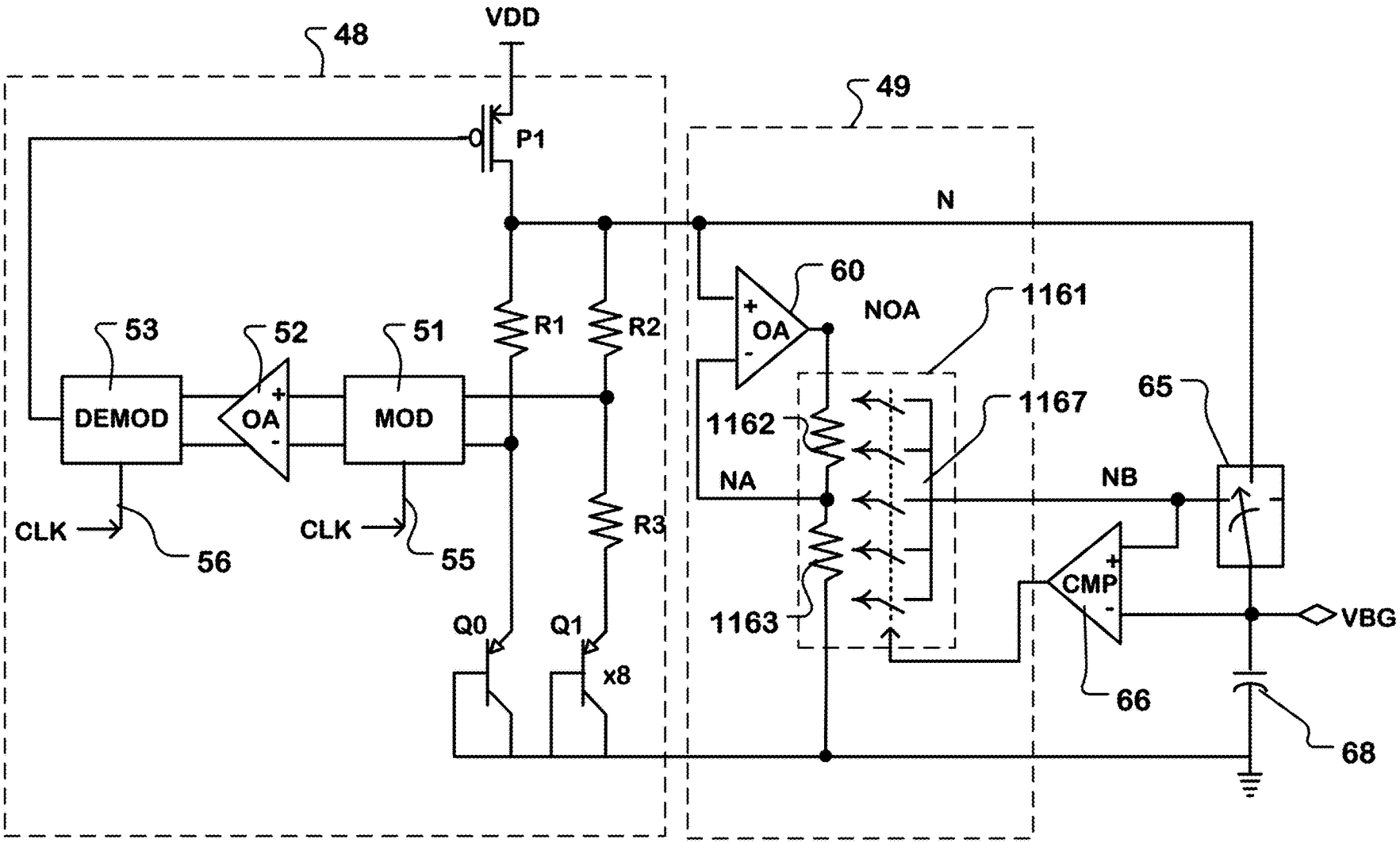
FIG. 7 is a circuit diagram of a fourth embodiment of a voltage reference generator as described herein.

Another alternative voltage reference generator is shown in FIG. 7. The configuration of the circuit in FIG. 7 is like that of FIG. 3, and like reference numerals are used for common components. In the embodiment of FIG. 7, the resistors R4, R5 and R6 and the register controlled resistor 61 which are arranged in two legs in the circuit of FIG. 3, are replaced by a single leg that comprises a register controlled voltage divider 1161 having a static tap point connected to node NA, and a selectable tap point connected to node NB. The register controlled voltage divider 1161 comprises a set of series connected resistors (schematically represented by resistor 1162 above node NA and resistor 1163 below node NA) with nodes between the resistors being selectable as tap points by set of switches 1167. (See FIG. 10 below, where node NA can be connected to node 1165). The set of switches 1167 is controlled by calibration logic as discussed above in connection with FIG. 4. In this manner, a resistance between node NA and node NB establish an offset voltage in the feedback path that is selectable by the calibration logic. In effect, the number of resistors between the static tap which is connected to node NA and the selectable tap which is connected to node NB is adjusted by the calibration logic. In this manner, the offset voltage between node NA and node NB can be established during calibration to maintain a stable bandgap reference voltage at node VBG, calibrated to compensate for variations caused by the differences in the first and second modes of operation of the dual mode bandgap reference circuit.

Figure 8:
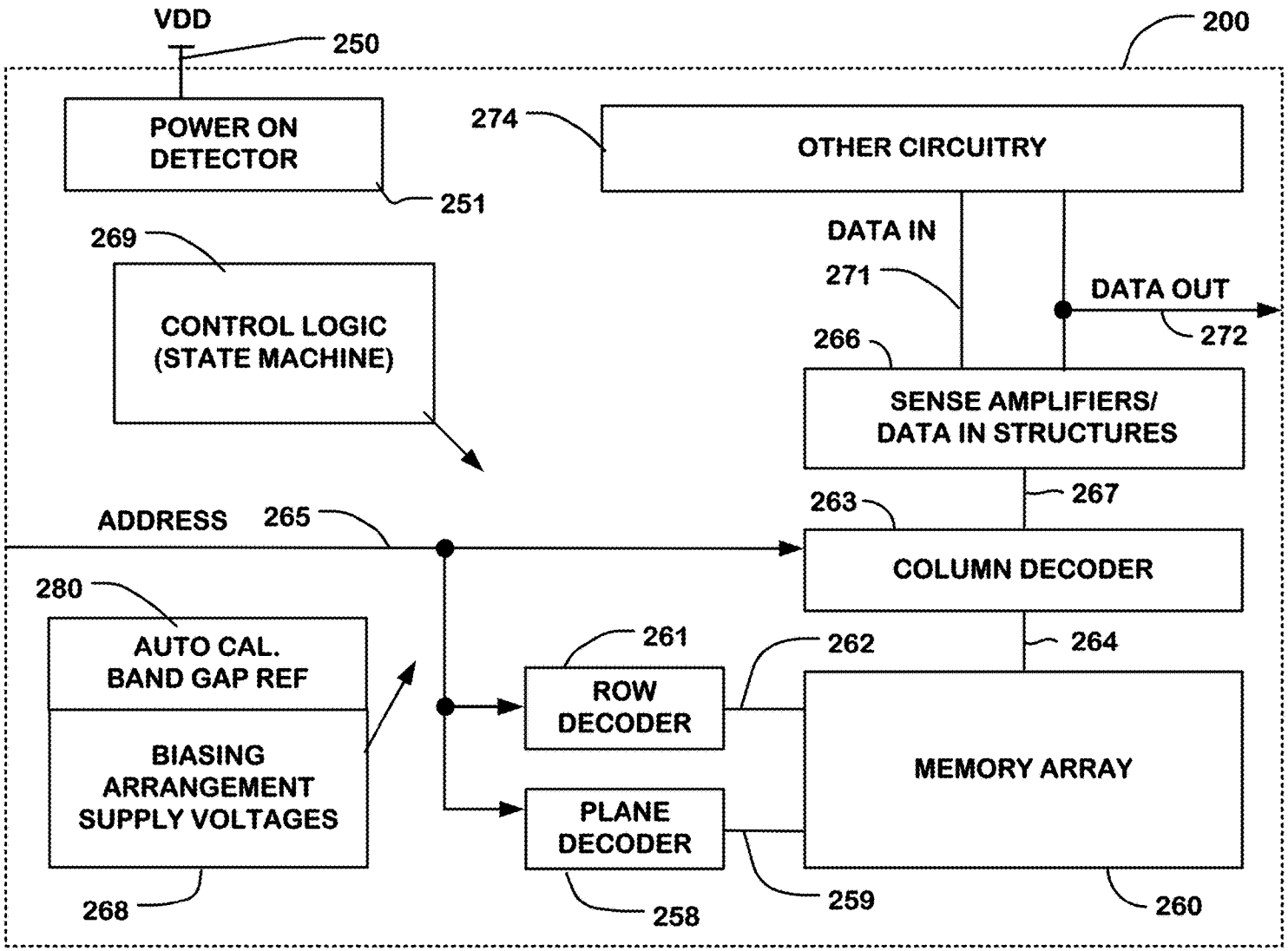
FIG. 8 is a simplified block diagram of an integrated circuit including an auto calibrated bandgap reference circuit as described herein.

FIG. 8 is a simplified block diagram of an integrated circuit 200 that includes an automatically calibrated bandgap reference circuit 280 like that discussed with reference to FIGS. 1-7, 9 and 10. In this example, the integrated circuit 200 comprises a memory device including a memory array 260 such as a 3D flash memory. In other embodiments, the integrated circuit 200 can comprise any type of circuit that utilizes a bandgap reference voltage, including a microprocessor, a graphics processor unit, an application-specific integrated circuit, the field programmable gate array, analog devices such as a radio receiver or transmitter, or other types of digital, analog and mixed signal integrated circuits.

In this example, the memory array 260 is coupled to the peripheral circuits including a row decoder 261 which is coupled by lines 262 to the memory array 260, a plane decoder 258 which is coupled by lines 259 to the memory array 260, and a column decoder 263 which is coupled to bit lines 264 of the memory array. Addresses are provided on line 265, which may include an address generator (not shown), for example. Sense amplifiers and data-in structures 266 provide data input and output paths through the column decoder 263 and bit lines 267 to the memory array. Output data is provided on line 272 for delivery off chip. Input data 271 in this example comes from other circuitry 274 on the circuit, which can include input circuits, processors, or other types of circuitry. Control logic 269 including a state machine is provided to generate control and timing signals necessary for operation of the memory. The control logic 269 can include logic to execute the procedures of FIGS. 2 and 4. Biasing arrangement supply voltages 268 are included, which produce a variety of voltages required during memory operations, and applied under the control of the control logic 269.

In this embodiment, an automatically calibrated bandgap reference 280, implemented as described above with reference to 1-7, 9 and 10, is coupled to the biasing arrangement supply voltages 268, and used with voltage regulators, voltage dividers, charge pumps and the like.

The integrated circuit 200 receives an external supply voltage VDD on line 250. A power-on detector circuit 251 is provided on the integrated circuit to detect a power-on event, and to generate a signal that is supplied to the state machine in the control logic 269, and to other circuitry on the chip. The state machine in the control logic 269 can control the calibration sequence as is described above in response to detection of the power-on event. Thus, although the calibration results stored in the automatically calibrated bandgap reference circuits described above can be lost during a power-off of that, upon power-on, an automatic calibration sequence is executed to recover or newly calibrate the circuit.

Figure 9:
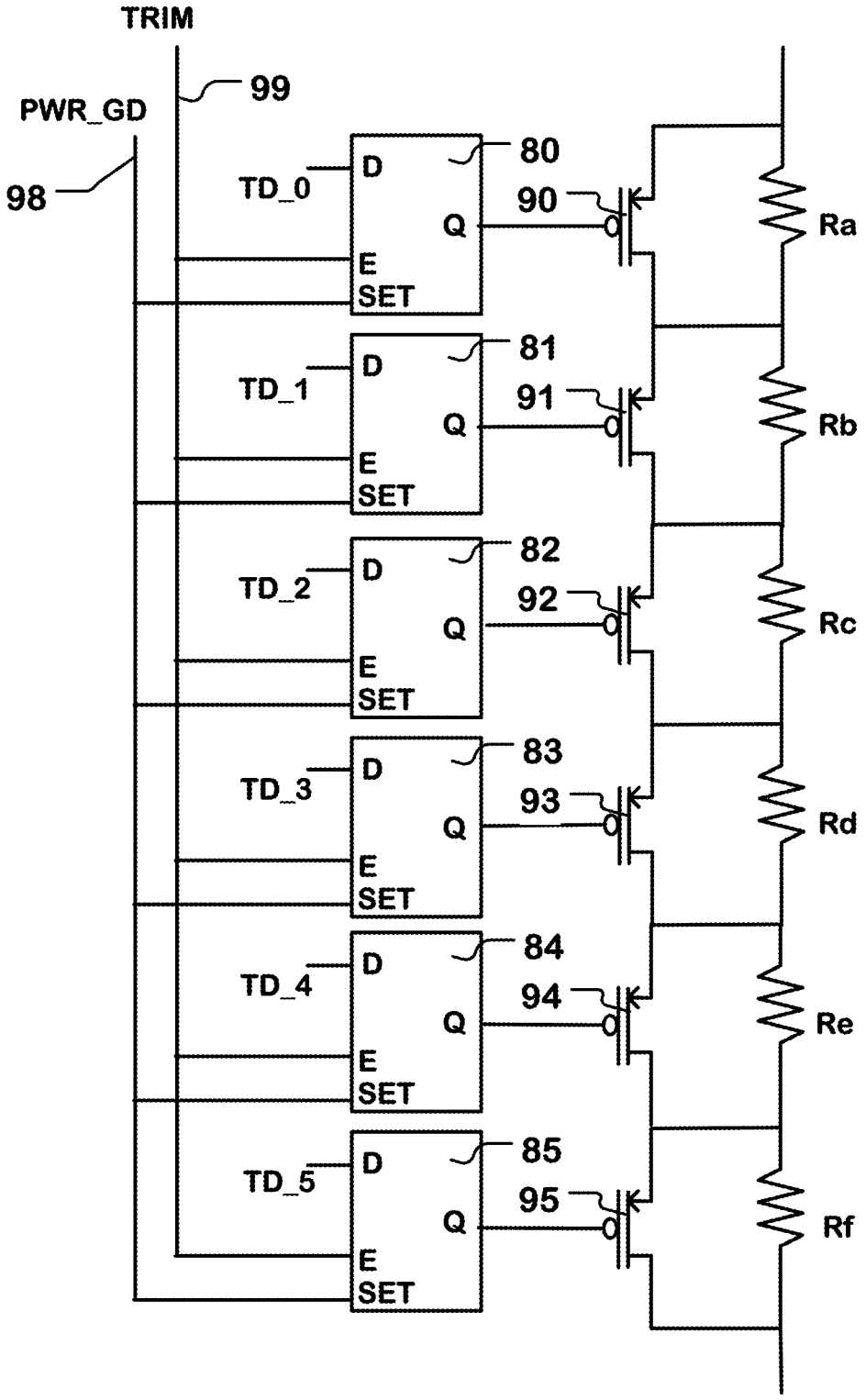
FIG. 9 is a diagram of a register-controlled resistor which can be used in embodiments of the voltage reference generators described herein.

FIG. 9 is a schematic diagram of one example of a register-controlled resistor such as can be utilized in the circuits shown in FIGS. 2 and 5. In this example, a register comprises a set of flip-flops 80-85, which are based on volatile SRAM-like memory cells that can lose data when power is not applied to the circuit.

The outputs of the flip-flops 80-85 control transistors in a resistor ladder. The control transistors in the resistor ladder in this example comprise p-channel MOS transistors 90-95. The resistor ladder also includes a set of resistors arranged in series, which in this example include resistors Ra to Rf. Transistor 90 has its source and drain terminals connected to nodes on each end of the resistor Ra. Thus, when the transistor 90 is turned on, the resistor Ra is bypassed by the low resistance path through the transistor 90. When the transistor 90 is turned off, the resistor Ra remains part of the series resistance. In a similar fashion, transistor 91 has its source and drain terminals connected to nodes on each end of resistor Rb. Transistor 92 has its source and drain terminals connected to nodes on each end of resistor Rc. Transistor 93 has its source and drain terminals connected to nodes on each end of resistor Rd. Transistor 94 has its source and drain terminals connected to nodes on each end of resistor Re. Transistor 95 has its source and drain terminals connected to nodes on each end of resistor Rf.

The resistance values for the resistors Ra to Rf are selected according to the needs of a particular embodiment, to provide for a range of resistance and a step size for trimming the resistance within the range. Thus, the values can be a combination of multiples of a base resistance R, such as 1*R, 2*R, 4*R, 8*R and so on.

For the purposes of use with the calibration logic described herein, the flip-flops 80-85 are capable of accepting and storing trim data TD_0 to TD_5 from the calibration logic as it adjusts the resistance of the register-controlled resistor. Also, the flip-flops 80-85 are capable of holding the trim value during operation of the circuit, and resetting after a power-on event. Thus, inputs to the flip-flops include a data input D connected to the trim data TD_0 to TD_5 from the calibration logic. Inputs to the flip-flops include an enable input E connected by line 99 to a control signal TRIM which is generated by the calibration logic or other portions of control logic on the integrated circuit to enable the flip-flops to capture the trim data. Inputs to the flip-flops also include a set input SET connected by line 98 to PWR_GD signal generated by, or generated in response to, a power-on detector on the integrated circuit, and indicates that the power supply voltage has been applied at a good level.

In this embodiment, for example, the flip-flops 80-85 are enabled to capture data on their data input D when the PWR_GD signal is high. Each flip-flop in the register captures the data when the SET and E inputs are high, and holds the data when the SET input is high and the E input is low.

In this example, the resistor ladder is illustrated utilizing a set of six series-connected resistors. Different numbers of resistors can be used. These resistors can be implemented in a variety of technologies that provide passive resistance or active resistance for use in a controllable resistance structure.

Figure 10:
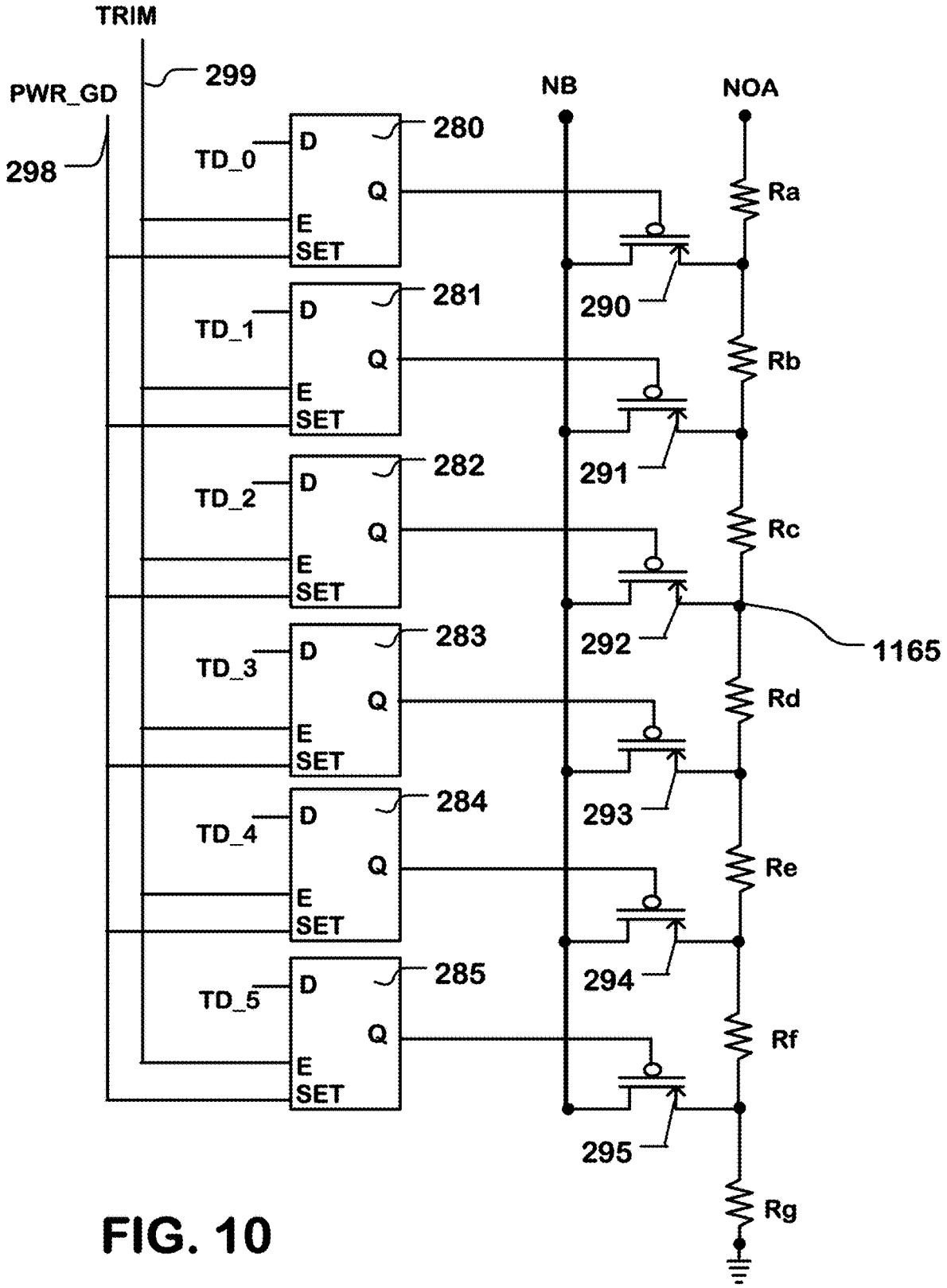
FIG. 10 is a diagram of a register-controlled voltage divider which can be used in embodiments of the voltage reference generators described herein.

FIG. 10 is a schematic diagram of one example of a register-controlled voltage divider, which can be utilized in the circuit shown in FIG. 6 in one configuration, and in the circuit shown in FIG. 7 in another configuration. In this example, a register comprises a set of flip-flops 280-285, which are based on volatile SRAM-like memory cells that can lose data when power is not applied to the circuit. The register-controlled voltage divider of FIG. 9 can be also be used in the circuit shown in FIG. 6, with at tap at a node (e.g. 1165) in the string as discussed below.

A set of series connected resistors in the example illustrated in FIG. 9 includes resistors Ra to Rg, having nodes between resistors that can be selected as tap points for the register controlled voltage divider, so that the resistance above the tap point and the resistance below the tap point are both adjustable by an output of the register. The set of series connected resistors can be connected on one end to the node NOA on the output of the operational amplifier 60 in the circuit of FIG. 2, and on the other end to the reference node.

Thus, in this example, the outputs of the flip-flops 280-285 control transistors 290-295 configured as switches to connect respective tap points in the set of series connected resistors to the node NB in the circuit of FIG. 3. The control transistors in this example comprise p-channel MOS transistors 290-295. Transistor 290 has its one terminal connected to a node between the resistor Ra and the resistor Rb, and the other terminal connected to the node NB in the circuit of FIG. 3. Thus, when the transistor 90 is turned on, the resistor Ra is the top resistor in the voltage divider and the combination of resistors Rb to Rg provide the bottom resistor in the voltage divider. The node NB is connected to the by a low resistance path through the transistor 290 to the selected tap point. In a similar fashion, transistor 291 has one terminal connected to a tap point between resistors Rb and Rc, and another terminal connected to the node NB. Transistor 292 has one terminal connected to a tap point between resistors Rc and Rd, and another terminal connected to the node NB. Transistor 293 has one terminal connected to a tap point between resistors Rd and Re, and another terminal connected to the node NB. Transistor 294 has one terminal connected to a tap point between resistors Re and Rf, and another terminal connected to the node NB. Transistor 295 has one terminal connected to a tap point between resistors Rf and Rg, and another terminal connected to the node NB.

The resistance values for the resistors Ra to Rg are selected according to the needs of a particular embodiment, to provide for a range of resistance and a step size for trimming the resistance within the range.

For the purposes of use with the calibration logic described herein, the flip-flops 280-285 are capable of accepting and storing trim data TD_0 to TD_5 from the calibration logic as it adjusts the resistance of the register-controlled resistor. Also, the flip-flops 280-285 are capable of holding the trim value during operation of the circuit, and resetting after a power-on event. Thus, inputs to the flip-flops include a data input D connected to the trim data TD_0 to TD_5 from the calibration logic. Inputs to the flip-flops include an enable input E connected by line 299 to a control signal TRIM which is generated by the calibration logic or other portions of control logic on the integrated circuit to enable the flip-flops to capture the trim data. Inputs to the flip-flops also include a set input SET connected by line 298 to PWR_GD signal generated by, or generated in response to, a power-on detector on the integrated circuit, and indicates that the power supply voltage has been applied at a good level.

In this embodiment, for example, the flip-flops 280-285 are enabled to capture data on their data input D when the PWR_GD signal is high. Each flip-flop in the register captures the data when the SET and E inputs are high, and holds the data when the SET input is high and the E input is low.

In this example, the voltage divider having top and bottom register controlled resistors is illustrated utilizing a set of seven series-connected resistors having six tap points. Different numbers of resistors can be used. These resistors can be implemented in a variety of technologies that provide passive resistance or active resistance for use in a controllable resistance structure.

The register controlled voltage divider of FIG. 9 can also be utilized to provide three register controlled resistors in series for use in the embodiment of FIG. 6 for example. In this configuration, the register controlled voltage divider of FIG. 9 can have a static (fixed) tap point (e.g. node 1165) which is connected to node NA in the circuit of FIG. 6, and a selectable tap point connected to node NB via the control transistors. The offset voltage between NA and NB can be positive or negative, and therefore the node NA may be tapped in the series of resistors at a position above or below the node NB in different circumstances.

In this embodiment, the register controlled voltage divider comprises a first register controlled resistor between node NOA and one of nodes NA and NB (the one closer to node NOA), a second register controlled resistor between nodes NA and NB, and a third register controlled resistor between the other of nodes NA and NB (the one closer to the reference node) and the reference node.

Of course, other types of register-controlled resistors can be utilized, including for example registers configured to set voltages used to control voltage controlled resistors. Other examples include other types of resistor ladders. Other examples are implemented using n-channel transistors, or combinations of n-channel and p-channel transistors.

A number of flowcharts illustrating operation of the voltage regulator circuit are described herein. The logic to execute these procedures can be implemented using processors programmed using computer programs stored in memory accessible to the computer systems and executable by the processors, by dedicated logic hardware, including field programmable integrated circuits, and by combinations of dedicated logic hardware and computer programs. With all flowcharts herein, it will be appreciated that many of the steps can be combined, performed in parallel or performed in a different sequence without affecting the functions achieved. In some cases, as the reader will appreciate, a rearrangement of steps will achieve the same results only if certain other changes are made as well. In other cases, as the reader will appreciate, a rearrangement of steps will achieve the same results only if certain conditions are satisfied. Furthermore, it will be appreciated that the flow charts herein show only steps that are pertinent to an understanding of the invention, and it will be understood that numerous additional steps for accomplishing other functions can be performed before, after and between those shown.

While the present invention is disclosed by reference to the preferred embodiments and examples detailed above, it is to be understood that these examples are intended in an illustrative rather than in a limiting sense. It is contemplated that modifications and combinations will readily occur to those skilled in the art, which modifications and combinations will be within the spirit of the invention and the scope of the following claims.

What is claimed is:

1. A circuit, comprising:

a voltage reference generator having a first mode and a second mode, to provide a first stage bandgap reference voltage to a first stage output node;

an adjustable voltage regulator connected to the first stage output node which generates a second stage bandgap reference voltage on a second stage output node having an offset from the first stage bandgap reference voltage; and a switch controlled to connect the first stage output node to a voltage reference node in the first mode, and to connect the second stage output node to the voltage reference node in the second mode; and calibration logic coupled to the voltage reference generator, which executes a calibration sequence including enabling the voltage reference generator in the first mode to produce a first mode reference voltage, holding the first mode reference voltage on a node having capacitance, and then enabling the voltage reference generator in the second mode to generate a second mode reference voltage, and calibrating the voltage reference generator in the second mode based on the first mode reference voltage held on the node and the second mode reference voltage to provide the bandgap reference voltage.

2. The circuit of claim 1, wherein the voltage reference generator includes a bandgap reference generator including feedback, and the first mode includes enabling a clock signal to modulate feedback in the bandgap reference generator, and the second mode includes disabling the clock signal.

3. The circuit of claim 1, wherein the voltage reference generator comprises a chopper-stabilized bandgap reference circuit having modulated feedback in the first mode, and having un-modulated feedback in the second mode.

4. The circuit of claim 1, wherein the voltage reference generator includes a register-controlled resistor, and the calibration sequence includes adjusting the register-controlled resistor.

5. The circuit of claim 1, wherein the voltage reference generator includes a controllable voltage divider, and the calibration sequence includes adjusting the controllable voltage divider.

6. The circuit of claim 1, wherein the voltage reference generator includes an adjustable register, and the calibration sequence is initiated after power is applied to the circuit, and includes adjusting the adjustable register from an initial value to a calibrated value.

7. The circuit of claim 1, including a power-on detector, and wherein the calibration logic is responsive to the power-on detector.

8. A circuit, comprising:

a bandgap reference generator generating a first stage bandgap reference voltage on a first stage output node, the bandgap reference generator having modulated feedback in a first mode, and having un-modulated feedback in a second mode;

an adjustable voltage regulator connected to the first stage output node which generates a second stage bandgap reference voltage on a second stage output node having an offset from the first stage bandgap reference voltage; and a switch controlled to connect the first stage output node to a voltage reference node in the first mode, and to connect the second stage output node to the voltage reference node in the second mode; and calibration logic which executes a calibration sequence including enabling the bandgap reference generator in the first mode to produce a first mode reference voltage, holding the first mode reference voltage on a node having capacitance, and then enabling the adjustable voltage regulator in the second mode, and calibrating the adjustable voltage regulator in the second mode relative to the first mode reference voltage held on the node to provide the bandgap reference voltage.

9. The circuit of claim 8, wherein the adjustable voltage regulator includes an adjustable register-controlled resistor, and the calibration sequence includes adjusting the adjustable register-controlled resistor from an initial value to a calibrated value.

10. The circuit of claim 8, wherein the bandgap reference generator is a chopper-stabilized bandgap reference circuit.

11. A method for generating a bandgap reference voltage on an integrated circuit, comprising:

enabling a voltage reference generator in a first mode to produce a first mode bandgap reference voltage;

sampling the first mode bandgap reference voltage to hold a sampled voltage;

enabling the voltage reference generator in a second mode to produce an initial second mode bandgap reference voltage;

calibrating the voltage reference generator in the second mode based on the sampled voltage and the initial second mode bandgap reference voltage to produce a calibrated bandgap reference voltage; and applying the calibrated bandgap reference voltage to a voltage reference node.

12. The method of claim 11, including during the first mode, enabling a clock signal to modulate feedback in the voltage reference generator, and during the second mode, disabling the clock signal.

13. The method of claim 11, wherein the voltage reference generator comprises a chopper-stabilized bandgap reference circuit having modulated feedback in the first mode, and having un-modulated feedback in the second mode.

14. The method of claim 11, wherein the voltage reference generator includes a register-controlled resistor, and calibrating the voltage reference generator in the second mode by adjusting the register-controlled resistor.

15. The method of claim 11, wherein the voltage reference generator includes a controllable voltage divider, calibrating the voltage reference generator in the second mode by adjusting the controllable voltage divider.

16. The method of claim 11, wherein the voltage reference generator includes an adjustable register, and calibrating the voltage reference generator in the second mode by adjusting the adjustable register.

17. The method of claim 11, wherein the voltage reference generator comprises:

a bandgap reference generator generating a first stage bandgap reference voltage on a first stage output node, the bandgap reference generator having modulated feedback in the first mode, and having un-modulated feedback in the second mode; and an adjustable voltage regulator connected to the first stage output node which generates a second stage bandgap reference voltage on a second stage output node having an offset from the first stage bandgap reference voltage, the method including:

connecting the first stage output node to the voltage reference node in the first mode, and connecting the second stage output node to the voltage reference node in the second mode.

18. The method of claim 17, wherein the adjustable voltage regulator includes an adjustable register-controlled resistor, the method including adjusting the adjustable register-controlled resistor from an initial value to a calibrated value.

19. The method of claim 17, wherein the bandgap reference generator is a chopper-stabilized bandgap reference circuit.

20. The method of claim 11, including executing said method in response to a power-on detector.

* * * * *